US005785776A

United States Patent [19]

Sircar

[11] Patent Number: 5,785,776

[45] Date of Patent: Jul. 28, 1998

[54] METHOD OF IMPROVING THE CORROSION RESISTANCE OF ALUMINUM ALLOYS AND PRODUCTS THEREFROM

[75] Inventor: Subhasish Sircar, Richmond, Va.

[73] Assignee: Reynolds Metals Company, Richmond, Va.

[21] Appl. No.: 659,788

[22] Filed: Jun. 6, 1996

[51] Int. Cl.[6] ..... C22F 1/04

[52] U.S. Cl. ..... 148/690; 148/689; 148/691; 148/694

[58] Field of Search ..... 148/689, 690, 148/691, 694, 417; 420/548

[56] References Cited

U.S. PATENT DOCUMENTS

| | | | |
|---|---|---|---|
| 2,859,323 | 11/1958 | McArthur et al. | 219/10.41 |
| 3,222,227 | 12/1965 | Baugh et al. | 148/11.5 |
| 3,235,416 | 2/1966 | Jenkins | 148/129 |
| 3,801,382 | 4/1974 | Ettenreich | 148/159 |
| 4,295,901 | 10/1981 | Robertson et al. | 148/12.7 |
| 4,415,374 | 11/1983 | Young et al. | 148/2 |
| 4,861,389 | 8/1989 | Bryant et al. | 148/3 |
| 4,909,858 | 3/1990 | Reiso | 148/2 |
| 5,133,811 | 7/1992 | Kirkwood et al. | 148/95 |
| 5,286,316 | 2/1994 | Wade | 148/550 |
| 5,306,359 | 4/1994 | Eppeland et al. | 148/511 |
| 5,340,418 | 8/1994 | Wei | 148/549 |
| 5,356,495 | 10/1994 | Wyatt-Mair et al. | 148/551 |
| 5,507,888 | 4/1996 | Dickson, Jr. et al. | 148/690 |

FOREIGN PATENT DOCUMENTS

| | | | |
|---|---|---|---|
| 665298 A1 | 11/1994 | European Pat. Off. | C22C 21/00 |
| 91/14794 | 10/1991 | WIPO | C22C 21/00 |
| 96/35819 | 11/1996 | WIPO | C22F 1/04 |

OTHER PUBLICATIONS

New Technologies for the Cooling and Quenching of Medium to Large Sized Aluminium Extrusions, Werner Strehmel and Miroslav Plata, ET96, Vol. 1, p. 317, 6th International Aluminum Extrusion Technology Seminar, May 14–17, 1996, Chicago, Illinois.

*Primary Examiner*—George Wyszomierski
*Assistant Examiner*—M. Alexandra Elve
*Attorney, Agent, or Firm*—Alan M. Biddison

[57] ABSTRACT

A method of improving the corrosion properties of an aluminum alloy product containing solid solution alloying elements includes the step of rapidly quenching the alloy product after it has been heated or hot deformed so as to maintain the alloying elements in solid solution to avoid microsegregation of the solid solution alloying elements and minimize preferential sites for corrosion onset.

15 Claims, 2 Drawing Sheets

METHOD OF IMPROVING THE CORROSION RESISTANCE OF ALUMINUM ALLOYS AND PRODUCTS THEREFROM

FIELD OF THE INVENTION

The present invention is directed to a method of improving the corrosion resistance of aluminum alloys and products therefrom and, in particular, a method of rapidly quenching aluminum alloys after a heating or hot deforming step to obtain a product exhibiting improved corrosion resistance.

BACKGROUND ART

In the prior art, various aluminum alloys have been proposed or developed to provide corrosion resistance in a variety of hostile environments. Examples of these types of aluminum alloys are AA1000, AA3000, and AA5000 type alloys.

These types of aluminum alloys are particularly adapted for various automotive industry applications because of their excellent formability, high strength, light weight and corrosion resistance.

Another alloy having improved corrosion resistance is disclosed in U.S. Pat. No. 5,286,316 to Wade, this patent being herein incorporated by reference in its entirety. This patent teaches an aluminum alloy having controlled amounts of manganese, silicon, titanium and iron which is particularly adapted for use as an extrusion alloy.

While these types of alloys offer significant corrosion properties over previously used alloys such as the AA1100 series type, their corrosion resistance still needs to be improved. These prior art alloys still exhibit pitting and blistering when subjected to highly acidic saline environments.

As such, a need has developed to improve the corrosion properties of aluminum alloys typically used in corrosive environments. In response to this need, the present invention provides a method wherein the corrosion properties of these types of alloys can be significantly improved by subjecting the alloys to a rapid quenching step following any processing step wherein the alloy is subjected to heating or hot deforming, for example, extruding, rolling, or the like.

SUMMARY OF THE INVENTION

Accordingly, it is a first object of the present invention to provide a method of improving the corrosion resistance properties of aluminum alloys.

Another object of the present invention is to provide a method of improving the corrosion resistance properties of extruded, rolled (formed at elevated temperature) aluminum alloys.

A still further object of the present invention is to improve the corrosion resistance of aluminum alloys of the type which have significant amounts of alloying elements which are designed to stay in solution over time.

Another object of the present invention is to improve the corrosion resistance properties of aluminum alloys by rapidly quenching the aluminum alloys after they have been subjected to a heating or hot deformation step such that the alloying elements thereof remain in solution.

Other objects and advantages of the present invention will become apparent as a description thereof proceeds.

In satisfaction of the foregoing objects and advantages, the present invention provides a method of improving the corrosion resistance of an aluminum alloy article containing solid solution alloying elements in amounts wherein the solid solution alloying elements preferably remain substantially in solution over time. The inventive method comprises the step of rapidly quenching the aluminum alloy article after the article has been subjected to one of heating and hot deforming at a temperature which puts the solid solution alloying elements in solution in a substantially uniform concentration. The rapid quenching maintains the uniform concentration of the solid solution alloying elements to improve the article's corrosion resistance properties.

Preferably, the aluminum alloy is an alloy selected from the AA3000 series alloys. More preferably, the aluminum alloy consists essentially of, in weight percent, about 0.1 to about 0.5% manganese, about 0.05 to 0.12% silicon, about 0.03 to 0.30% titanium, about 0.05 to 0.5% iron, not more than 0.40% copper, with the balance being aluminum and inevitable impurities.

The rapid quenching step can either follow a hot deforming step such as extrusion, rolling etc. or a heating step wherein the aluminum alloy article is brazed. Preferably, the rapid quenching step quenches the aluminum alloy article from the heating or hot deforming temperature to at least ambient temperature in a very short time. Optimally, the aluminum alloy is quenched using a high pressure water or other quenching medium (cryogenics, etc.) spray directly downstream of the heating or hot deforming step.

BRIEF DESCRIPTION OF THE DRAWINGS

Reference is now made to the drawings accompanying the invention wherein.

DESCRIPTION OF THE PREFERRED EMBODIMENTS

Figure 1:
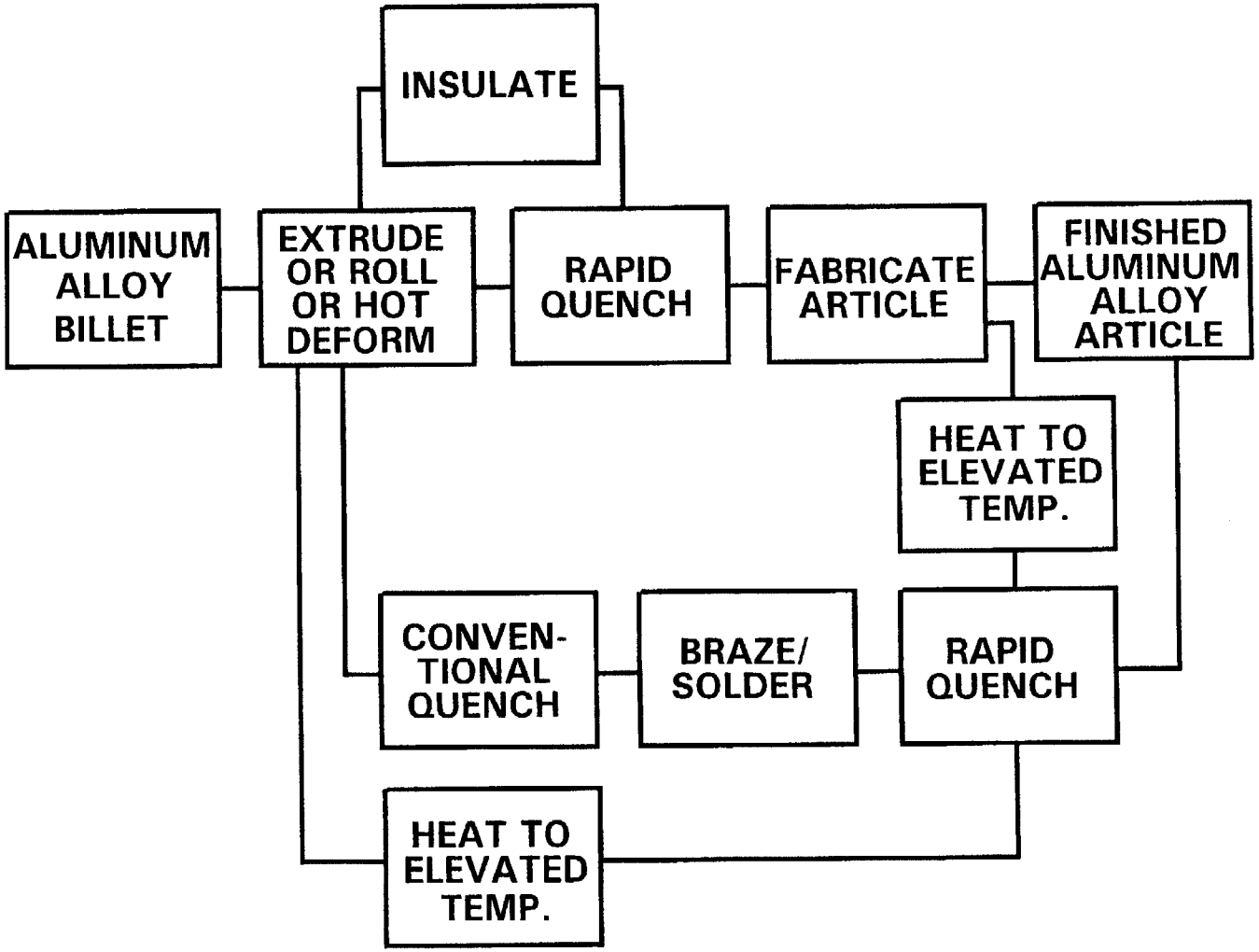
FIG. 1 is a schematic flow diagram of one embodiment of the inventive processing.

The present invention provides a significant improvement in the corrosion resistance of aluminum alloys which are intended for use in corrosive environments. The aluminum alloys adapted for use with the present invention include all aluminum alloys that contain significant amounts of solute alloying additions wherein the solute alloying additions preferably are intended to remain in solution over time.

Other alloys that are also adapted for use for the inventive method include the AA2000 series, AA5000 series, AA6000, AA7000 series and AA8000 series alloys that use alloying additions described above and maintain them in solid solution in whatever type of aluminum alloy article is made from these alloy compositions.

A more preferred class of alloys for the invention is of the AA3000 series type. An even more preferred alloy is that disclosed in U.S. Pat. No. 5,286,316 to Wade.

Certain alloying elements, such as titanium, are difficult to keep in solid solution. If the temperature of an alloy containing such elements drops prior to quenching, the elements precipitate which can result in decreased corrosion performance of products made from the alloys.

Another preferred alloy consists essentially, in weight percent, of not more than 0.40% Cu, up to 0.5% Fe, from 0.1 to 0.5% Mn, from 0.03 to 0.30% Ti from 0.05 to 0.12% Si, from 0.06 to 1.0% Zn, with the balance aluminum and incidental impurities.

It has been discovered that rapidly quenching these types of aluminum alloys after they have been subjected to heating or hot deformation minimizes or eliminates microsegregation in the thus quenched alloy. When the solute alloying additions of the alloy are in solution as a result of heating or hot deformation, the invention of rapid quenching maintains these solute additions in solution. The rapid quenching avoids microsegregation in the thus quenched article. It is believed that the microsegregation which results from the solute alloying elements leaving solution act as preferential sites for the onset of corrosion. Using the inventive method, the solute alloy additions remain uniformly dispersed throughout the alloy so that preferential sites of microsegregation are not created to permit unwanted types of corrosion to occur.

The temperature at which a given aluminum alloy should be at, prior to the onset of the rapid quenching, is not an absolute value but rather a function of the specific alloy being quenched. It is believed that, as a general rule, the aluminum alloy should be at a temperature of at least 398° C., preferably of at least 427° C., prior to initiation of the rapid quenching. The rapid quenching should be such that the article being quenched is cooled substantially instantaneously so that no opportunity exists for microsegregation to occur of any solute alloying additions. One mode of obtaining this rapid quench is to immerse the heated aluminum alloy in water. Of course, other cooling means could be used such as water sprays or a combination of water sprays and water immersion as well as other types of coolants like cryogens. The rapid quenching of the aluminum alloy should be done in a time span on the order of seconds or fractions thereof. As will be described below, allowing the heated aluminum alloys to cool naturally or via forced air can result in a cooling rate which can promote microsegregation and less than optimum corrosion resistance.

Referring now to FIG. 1, an exemplary flow diagram is illustrated showing different embodiments of the inventive method. This flow diagram is directed to hot extruding an aluminum alloy into a finished aluminum alloy part. However, the invention is suitable for use in conjunction with various hot deformation and/or heat treating processes.

AA3000 series aluminum alloys are commonly formed into billets and subsequently extruded into a shape for fabrication into automotive components. Typically, with the present invention, the aluminum alloy billet is heated to a temperature above the solutionizing temperature, for instance, between about 538° C. and 560° C. The billet passes through the extrusion die and before the temperature of the extruded article drops below the solutionizing temperature, the article is rapidly quenched to a temperature where the kinetics of precipitation is negligible, for instance, to about ambient temperature. For instance, quenching from elevated to ambient temperature may require not more than one second, that is, one second or less. In a preferred mode, spray nozzles are positioned directly downstream of the article exit plane. Downstream of the spray nozzles, the extruded part enters a channel or pipe which is supplied with water to assure that the rapid quenching takes place. The extruded part can then be fabricated into a component such as an automotive component.

FIG. 1 also shows two alternatives to rapid quenching of the extruded part. In one option, the part is conventionally quenched. In this conventional quenching, the extruded part is subjected to air cooling for a period of time prior to entering the conventional quench station. During this air cooling, the part temperature can drop significantly, e.g. 50° to 200° C. This slow cooling stage can lead to the unwanted microsegregation described above.

Following the conventional quench step, the shape can then be brazed, soldered or welded as part of the fabrication sequence. During joining, the temperature of the part is raised to a temperature which will cause the solute alloying additions in the aluminum alloy to go into solution. As described in U.S. Pat. No. 5,286,316, a typical brazing cycle heats the aluminum shape to about 590° C. After this heating of the extruded shape, brazed aluminum alloy part is subjected to the rapid quenching step to assure that the solute alloying elements are uniformly distributed in the product microstructure.

As a further option, the part exiting the extruder can be insulated to maintain it at a solutionizing temperature prior to the rapid quenching step.

Likewise, an aluminum alloy article that is subjected to soldering can also be subjected to rapid quenching of the thus heated aluminum alloy part or portion thereof. Typically, only a portion of the part to be soldered is heated and only this portion would require the rapid quenching for improved corrosion resistance in the soldered joint area.

All of the embodiments discussed in FIG. 1, either heating or hot deformation, are followed by the rapid quenching step to assure that the solute alloying elements are maintained in solution so as to avoid or eliminate microsegregation sites for corrosion.

Figure 2:
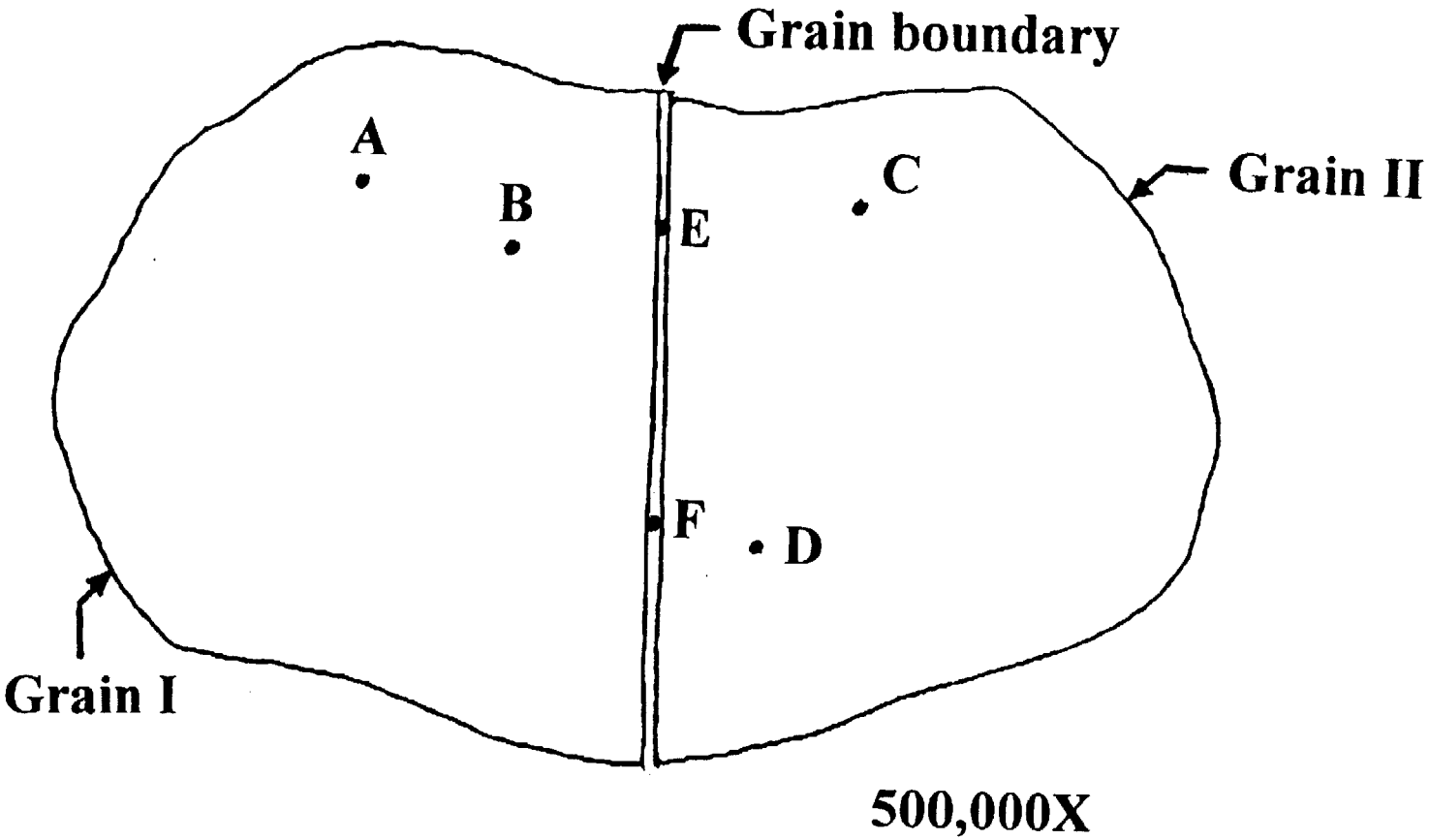
FIG. 2 is a schematic of a grain microstructure and chemistry information location of an aluminum alloy extrusion processed according to the invention.

FIG. 2 depicts schematic drawing of two grains, GI and GII, in either a poorly quenched or a super quenched extruded sample. The sample is made and processed as described above for the rapidly quenched parts or as described in the tables below for conventional quenching. In different alloys, as in the case of AA3102, other AA3000 alloys, AA2000, AA6000 series or AA7000 series, there is a difference in the way the various elements segregate. This is also true for other elements, but the present investigation focuses primarily on Cu and Ti.

At a 500,000 X magnification, it is noticed that in a super quenched sample there is no or very little variation in the Cu or Ti concentration difference between any location in GI or GII sites A, B, C and D. There is also no difference in solute concentration between sites A, B, C, or D in the grains and the grain boundary sites E and F. Thus, the concentration profile of the copper and titanium is substantially uniform throughout the material. However, in a poorly quenched product, every location shows a unique concentration profile when compared within GI, or within GII or between GI and GII and also when compared to any location in the grain boundary.

With the various corrosion tests performed, the super quenching has a profound positive effect in resisting corrosion. Samples that were super quenched have much better corrosion resistance than samples that were poorly quenched after a rolling, extruding or other high temperature deformation process.

This effect may be explained from the point of view of microgalvanic cells that are formed when the alloy is poorly quenched due to the segregation of the alloying elements that takes place at a microlevel. Ultimately, this manifests itself into localized macroanodic dissolution and hence pitting. In super or rapidly quenched samples, these microgalvanic cells are not formed due to the highly uniform nature of elemental distribution and hence pitting corrosion is avoided and a more uniform generalized corrosion occurs.

It is believed that the microsegregation of the solute alloying elements in prior art quenched material contributes to the blistering and/or pitting of these parts when subjected to corrosion testing, specifically if the material contains elements that segregate easily. The rapidly quenched extrusion has a substantially uniform concentration of the solute alloying additions throughout and little or no microsegregation exists. Consequently, potential sites for corrosion for these rapidly quenched articles are vastly reduced or eliminated.

In order to demonstrate the surprising results associated with the inventive rapid quenching, a series of experiments were conducted to compare rapidly quenched aluminum alloy extruded parts with aluminum alloy extruded parts subjected to conventional processing. The following comparisons are intended to be only exemplary of the present invention and not to be considered as limiting thereto.

In these experiments, nine different alloy compositions were selected for comparison purposes, see Table 1. These alloys were cast into billet; homogenized and extruded to provide test articles. The billets were homogenized and extruded using the conditions described in U.S. Pat. No. 5,286,316.

The test articles were then subjected to corrosion testing as per ASTM Standard G85 (hereinafter corrosion testing). In this testing, the test article was cut to a six or 12 inch length and subjected to a cyclical salt-water acetic acid spray test environment as per the ASTM standard referenced above. After exposure for a desired period of time, the specimens were cleaned in an acid solution to remove the corrosion products and subjected to 10 psi pressure. While pressurized, the test article was immersed in water to determine if the integrity of the test article had been compromised by the existence of one or more through holes. If a through hole existed after a set duration in the corrosive environment, the result was designated by an F (two samples for each specific test were used so that the test results vary from either two passes, two failures, or one pass and one failure, 2P, 2F and P and F, respectively).

Corrosion test results are shown in Table 2 for the alloy compositions of Table 1. These test articles were subjected to conventional quenching after the extrusion step described above, i.e. natural cooling below the solutionizing temperature prior to water quenching.

As is evident from Table 2, alloy I which is representative of an AA3102 alloy showed failure in as early as eight days. Alloys A–H which correspond generally to the alloy of U.S. Pat. No. 5,286,316 offer slightly improved results. For example, group No. 7, alloy D, lasted 12 days before a failure occurred in the corrosion test. All alloys showed failures well before 20 days of testing.

Tables 3 and 4 demonstrate the improved results when the same test articles were subjected to the rapid quenching of the invention. In Table 3, a key is provided which details the three different temperatures used to heat the test articles prior to rapid quenching. The key also indicates the amount of time the test article is held at a particular temperature. Similarly, Table 4 shows a key using two different temperatures with the same hold times. Table 4 also provides the results of a 40 day experiment duration for the corrosion tests.

When comparing Tables 3 and 4 with Table 2, it is clearly evident that the corrosion resistance of the tested articles is improved when subjected to the rapid quenching of the invention. More specifically, alloy A when conventionally quenched showed at least one failure in eight days and two failures in ten days. When the same alloy was subjected to rapid quenching, test specimens lasted for ten days without a failure. Group No. 9, alloy E, shows successful tests in 31 days in Table 3 and up to 40 days in Table 4. This is contrasted with the corrosion test results in Table 2 wherein the Group No. 9, alloy E, could not last 20 days in the corrosive test environment without failure.

While the tables demonstrate the superior performance of alloys processed in accordance with the present invention when subjected to tests for pitting resistance, it also has been demonstrated that the invention provides products with improved resistance to blistering.

Although the alloy compositions described in Table 1 may be preferred compositions for this application, it is believed that other aluminum alloy compositions can be used with the inventive method. Any aluminum alloys which utilize solute alloy additions would also be expected to exhibit improved corrosion resistance when rapidly quenched after being subjected to a heating or hot deforming step which would place the solute alloying elements in solution.

As such, an invention has been disclosed in terms of preferred embodiments thereof which fulfill each and every one of the objects of the present invention as set forth hereinabove and provides a new and improved method of enhancing the corrosion resistance of aluminum alloy articles.

Of course, various changes, modifications and alterations from the teaching of the present invention may be contemplated by those skilled in the art without departing from the intended spirit and scope thereof. Accordingly, it is intended that the present invention only be limited by the terms of the appended claims.

TABLE 1

ALLOY COMPOSITION ANALYSIS (BALANCE ALUMINUM)

| Alloy** Designation | Si | Fe | Mn | Mg | Cr | Ni | Zn |
|---|---|---|---|---|---|---|---|
| A | 0.07 | 0.20 | 0.26 | <0.01 | 0.0006 | <0.01 | 0.06 |
| B | 0.06 | 0.20 | 0.26 | <0.01 | 0.0010 | <0.01 | 0.03 |
| C | 0.07 | 0.21 | 0.26 | <0.01 | 0.0005 | <0.01 | 0.03 |
| D | 0.07 | 0.20 | 0.26 | <0.01 | 0.0009 | <0.01 | 0.03 |
| E | 0.06 | 0.20 | 0.26 | <0.01 | 0.0016 | <0.01 | 0.03 |
| F | 0.07 | 0.20 | 0.27 | <0.01 | 0.0009 | <0.01 | 0.03 |
| G | 0.06 | 0.22 | 0.29 | <0.01 | 0.0010 | <0.01 | 0.03 |
| H | 0.06 | 0.21 | 0.27 | <0.01 | <0.01 | <0.01 | 0.03 |
| I* | 0.06 | 0.51 | 0.35 | <0.01 | <0.01 | <0.01 | 0.02 |

*Represents AA3102 (0.024 Cu, 0.0332 Ti)

**Copper levels are maintained to be less than about 0.02%, titanium levels are maintained less than 0.30%

TABLE 2

TEST ARTICLE CORROSION TEST RESULTS (CONVENTIONAL QUENCH)

| | | Experiment Duration (in days) | | | | | | | | | | | | | | | | |
|---|---|---|---|---|---|---|---|---|---|---|---|---|---|---|---|---|---|---|
| Group # | Alloy | 4 | 5 | 6 | 7 | 8 | 9 | 10 | 11 | 12 | 13 | 14 | 15 | 16 | 17 | 18 | 19 | 20 |
| 1 | A | 2P | 2P | 2P | 2P | 2P | 2P | 2P | 2P | PF | PF | 2P | 2P | 2P | PF | 2P | PF | 2P |
| 2 | A | 2P | 2P | 2P | 2P | 2P | PF | 2P | 2P | PF | 2P | 2P | 2P | 2P | 2F | 2P | PF | PF |
| 3 | B | 2P | 2P | 2P | 2P | 2P | 2P | 2P | 2P | 2P | 2P | 2P | PF | 2P | 2F | PF | 2P | PF |
| 4 | B | 2P | 2P | 2P | 2P | 2P | 2P | 2P | 2P | 2P | PF | 2P | 2P | PF | 2P | PF | 2P | PF |
| 5 | C | 2P | 2P | 2P | 2P | 2P | 2P | 2P | PF | 2F | PF | PF | PF | 2F | PF | 2P | 2F | 2F |
| 6 | C | 2P | 2P | 2P | 2P | 2P | 2P | 2P | 2F | 2P | PF | 2P | PF | 2F | 2F | PF | PF | 2F |
| 7 | D | 2P | 2P | 2P | 2P | 2P | 2P | 2P | 2P | PF | PF | 2F | PF | 2F | 2F | 2F | 2F | 2F |
| 8 | D | 2P | 2P | 2P | 2P | 2P | 2P | 2P | 2P | 2P | PF | PF | 2P | 2F | 2F | 2F | 2F | 2F |
| 9 | E | 2P | 2P | 2P | 2P | 2P | 2P | 2P | 2P | 2P | 2P | 2P | PF | PF | F | PF | 2F | PF |
| 10 | E | 2P | 2P | 2P | 2P | 2P | 2P | 2P | 2P | 2P | PF | 2P | 2P | PF | 2F | PF | 2F | 2F |
| 11 | F | 2P | 2P | 2P | 2P | 2P | 2P | PF | 2P | 2P | 2F | PF | 2F | 2F | 2F | 2F | 2F | 2F |
| 12 | F | 2P | 2P | 2P | 2P | 2P | 2P | 2P | 2P | 2P | 2P | PF | PF | PF | PF | 2F | 2F | 2F |
| 13 | G | 2P | 2P | 2P | 2P | 2P | 2P | PF | PF | 2F | 2P | PF | 2F | 2F | 2F | 2F | 2F | 2F |
| 14 | G | 2P | 2P | 2P | 2P | 2P | 2P | 2P | 2P | 2P | PF | PF | 2P | 2P | PF | PF | 2F | 2F |
| 15 | H | 2P | 2P | 2P | 2P | 2P | 2P | 2P | PF | PF | 2P | PF | 2P | PF | 2F | 2F | 2F | 2F |
| 16 | H | 2P | 2P | 2P | 2P | 2P | 2P | PF | 2P | PF | PF | PF | 2P | 2F | 2F | 2F | 2F | 2F |
| 17 | I | 2P | 2P | 2P | 2P | PF | PF | 2F | 2F | 2F | 2F | 2F | 2F | 2F | 2F | 2F | 2F | 2F |

TABLE 3

TEST ARTICLE CORROSION TEST RESULTS WITH RAPID QUENCH (UP TO 31 DAYS)

| Group # | 1 | | | | | | 2 | | | | | | 3 | | | | | | 4 | | | | | |
|---|---|---|---|---|---|---|---|---|---|---|---|---|---|---|---|---|---|---|---|---|---|---|---|---|
| Alloy | A | | | | | | A | | | | | | B | | | | | | B | | | | | |
| Treatment | A | A | B | B | C | C | A | A | B | B | C | C | A | A | B | B | C | C | A | A | B | B | C | C |
| (see Key) | 1 | 2 | 1 | 2 | 1 | 2 | 1 | 2 | 1 | 2 | 1 | 2 | 1 | 2 | 1 | 2 | 1 | 2 | 1 | 2 | 1 | 2 | 1 | 2 |
| 10 Day | P | P | P | P | P | P | P | P | P | P | P | P | P | P | P | P | P | P | P | P | P | P | P | P |
| Test #1 | P | P | P | P | P | P | P | P | P | P | P | P | P | P | P | P | P | P | P | P | P | P | P | P |
| | P | P | P | P | P | P | P | P | P | P | P | P | P | P | P | P | P | P | P | P | P | P | P | P |
| Test #2 | P | P | P | P | P | P | P | P | P | P | P | P | P | P | P | P | P | P | P | P | P | P | P | P |
| 20 Day | F | P | P | P | P | F | P | P | P | P | P | P | P | P | P | P | P | P | P | P | P | P | P | F |
| Test #1 | F | P | F | F | P | F | F | P | P | F | P | F | F | P | P | P | P | P | P | P | P | P | P | F |
| | F | P | P | P | P | F | P | P | F | P | P | P | P | P | P | P | P | P | P | P | | P | P | F |
| Test #2 | F | P | P | F | F | F | F | F | F | P | F | F | F | P | P | P | F | F | P | P | P | F | F | F |
| 31 Day | F | | P | P | P | P | P | P | P | P | P | P | P | P | P | P | P | P | P | P | P | P | P | P |
| Test #1 | F | F | P | F | F | P | F | F | F | P | F | F | P | P | F | P | P | P | P | P | P | P | P | P |
| 30 Day | F | F | F | F | F | F | F | F | F | P | P | F | P | P | P | P | P | P | P | P | F | F | P | F |
| Test #2 | F | F | F | F | F | F | F | F | F | P | P | F | F | P | P | F | F | F | F | F | F | F | P | F |

| Group # | 5 | | | | | | 6 | | | | | | 7 | | | | | | 8 | | | | | |
|---|---|---|---|---|---|---|---|---|---|---|---|---|---|---|---|---|---|---|---|---|---|---|---|---|
| Alloy | C | | | | | | C | | | | | | D | | | | | | D | | | | | |
| Treatment | A | A | B | B | C | C | A | A | B | B | C | C | A | A | B | B | C | C | A | A | B | B | C | C |
| (see Key) | 1 | 2 | 1 | 2 | 1 | 2 | 1 | 2 | 1 | 2 | 1 | 2 | 1 | 2 | 1 | 2 | 1 | 2 | 1 | 2 | 1 | 2 | 1 | 2 |
| 10 Day | P | P | P | P | P | P | P | P | P | P | P | P | P | P | P | P | P | P | P | P | P | P | P | P |
| Test #1 | F | F | P | P | F | F | F | P | P | F | P | P | P | P | P | P | P | P | P | P | P | F | P | P |
| | F | F | F | F | F | F | F | F | P | P | P | F | P | P | P | P | P | P | P | P | P | P | P | P |
| Test #2 | F | F | F | F | F | F | F | F | F | F | F | F | P | P | P | P | P | F | P | P | P | P | P | P |
| 20 Day | F | F | F | F | F | F | F | F | F | F | F | F | F | P | P | F | P | F | F | P | P | F | P | F |
| Test #1 | F | F | F | F | F | F | F | F | F | F | F | F | F | F | F | F | P | F | F | F | F | F | F | F |
| | F | F | F | | F | F | F | F | F | F | F | F | P | P | P | P | P | F | F | P | P | P | P | P |
| Test #2 | F | F | F | F | F | F | F | F | F | F | F | F | F | P | P | F | F | F | F | F | F | P | F | F |
| 31 Day | F | F | F | F | F | F | F | F | F | F | F | F | F | P | P | P | F | F | F | F | P | P | F | F |
| Test #1 | F | F | F | F | F | F | F | F | F | F | F | F | F | F | F | F | F | F | F | F | P | F | F | F |
| 30 Day | F | F | F | F | F | F | F | F | P | F | F | F | F | F | F | F | F | F | F | F | F | F | F | F |
| Test #2 | F | F | F | F | F | F | F | F | F | F | F | F | F | F | F | F | F | F | F | F | F | F | F | F |

| Group # | 9 | | | | | | 10 | | | | | | 11 | | | | | | 12 | | | | | |
|---|---|---|---|---|---|---|---|---|---|---|---|---|---|---|---|---|---|---|---|---|---|---|---|---|
| Alloy | E | | | | | | E | | | | | | F | | | | | | F | | | | | |
| Treatment | A | A | B | B | C | C | A | A | B | B | C | C | A | A | B | B | C | C | A | A | B | B | C | C |
| (see Key) | 1 | 2 | 1 | 2 | 1 | 2 | 1 | 2 | 1 | 2 | 1 | 2 | 1 | 2 | 1 | 2 | 1 | 2 | 1 | 2 | 1 | 2 | 1 | 2 |
| 10 Day | P | P | P | P | P | P | P | P | P | P | P | P | P | P | P | P | P | P | P | P | P | P | P | P |
| Test #1 | P | P | P | P | P | P | P | P | P | P | P | P | P | P | P | P | P | P | P | P | P | P | P | P |
| | P | P | P | P | P | P | P | P | P | P | P | P | P | P | P | P | P | P | P | P | P | P | P | P |
| Test #2 | P | P | P | P | P | P | P | P | P | P | P | P | F | P | P | P | P | P | F | P | F | P | P | F |
| 20 Day | P | P | P | P | P | P | F | P | P | P | P | P | F | P | P | F | P | F | F | P | F | F | P | F |

TABLE 3-continued

TEST ARTICLE CORROSION TEST RESULTS WITH RAPID QUENCH (UP TO 31 DAYS)

| | | | | | | | | | | | | | | | | | | | | | | | | |
|---|---|---|---|---|---|---|---|---|---|---|---|---|---|---|---|---|---|---|---|---|---|---|---|---|
| Test #1 | F | P | P | P | P | P | F | F | P | P | P | P | F | F | F | F | P | F | F | P | F | F | F | F |
| | F | P | P | P | P | P | P | P | P | P | P | P | P | P | P | P | P | F | F | P | P | P | P | F |
| Test #2 | F | P | P | P | P | P | P | P | P | P | P | F | F | P | P | P | F | F | F | F | F | F | F | F |
| 31 Day | F | P | P | P | P | F | P | P | P | P | P | F | P | | P | F | | F | P | P | P | P | P | F |
| Test #1 | F | P | F | P | P | F | P | P | F | P | P | F | F | P | F | F | F | F | P | F | F | P | F | F |
| 30 Day | F | P | P | P | P | F | F | P | F | P | F | F | F | F | F | F | F | F | F | F | F | F | F | F |
| Test #2 | F | P | P | F | F | F | F | F | F | F | F | F | F | F | F | F | F | F | F | F | F | F | F | F |

| Group # | 13 | | | | | | 14 | | | | | | 15 | | | | | | 16 | | | | | |
|---|---|---|---|---|---|---|---|---|---|---|---|---|---|---|---|---|---|---|---|---|---|---|---|---|
| Alloy | G | | | | | | G | | | | | | H | | | | | | H | | | | | |
| Treatment | A | A | B | B | C | C | A | A | B | B | C | C | A | A | B | B | C | C | A | A | B | B | C | C |
| (see Key) | 1 | 2 | 1 | 2 | 1 | 2 | 1 | 2 | 1 | 2 | 1 | 2 | 1 | 2 | 1 | 2 | 1 | 2 | 1 | 2 | 1 | 2 | 1 | 2 |
| 10 Day | P | P | P | P | P | P | P | P | P | P | P | P | P | P | P | P | P | P | P | P | P | P | P | P |
| Test #1 | P | P | P | P | P | P | P | P | P | P | P | P | P | P | P | P | P | P | F | P | P | P | P | P |
| | P | P | P | P | P | F | P | P | P | P | P | P | P | P | P | P | P | P | P | P | P | P | P | P |
| Test #2 | P | P | P | P | F | F | P | P | P | P | P | P | P | P | P | P | P | P | F | P | P | F | P | F |
| 20 Day | F | P | F | F | P | F | F | P | P | F | P | P | F | P | P | P | P | P | F | F | F | F | P | F |
| Test #1 | F | P | F | F | P | F | F | P | F | F | P | P | F | P | P | P | F | F | F | F | F | F | P | F |
| | P | P | F | F | P | F | F | P | P | P | P | F | F | P | P | P | P | F | F | P | P | P | P | F |
| Test #2 | P | P | F | F | P | F | F | P | P | P | F | F | F | P | P | P | P | F | F | F | P | F | F | F |
| 31 Day | P | P | F | F | P | F | P | P | P | P | P | P | P | P | P | F | P | P | P | P | P | P | F | F |
| Test #1 | F | F | F | F | F | F | F | F | P | F | F | P | F | P | F | F | F | F | F | F | F | F | F | F |
| 30 Day | F | F | F | F | F | F | F | F | P | P | F | F | P | P | P | P | F | F | F | F | F | F | F | F |
| Test #2 | F | F | F | F | F | F | F | F | P | F | F | F | F | F | F | F | F | F | F | F | F | F | F | F |

| Group # | 17 | | | | | |
|---|---|---|---|---|---|---|
| Alloy | I | | | | | |
| Treatment | A | A | B | B | C | C |
| (see Key) | 1 | 2 | 1 | 2 | 1 | 2 |
| 10 Day | F | F | F | P | P | F |
| Test #1 | F | F | F | F | P | F |
| | P | F | F | F | P | F |
| Test #2 | F | F | F | F | F | F |
| 20 Day | F | F | F | F | F | F |
| Test #1 | F | F | F | F | F | F |
| | F | F | F | F | F | F |
| Test #2 | F | F | F | F | F | F |
| 31 Day | F | F | F | F | F | F |
| Test #1 | F | F | F | F | F | F |
| 30 Day | F | F | F | F | F | F |
| Test #2 | F | F | F | F | F | F |

Key
A = 800° F.
B = 900° F.
C = 1022° F.
1 = 0 Hour Hold
2 = 1 Hour Hold
P = Pass
F = Fail

TABLE 4

TEST ARTICLE CORROSION TEST RESULTS WITH RAPID QUENCH (Up to 40 days)

| Group # | Group 3 | | | | Group 4 | | | | Group 9 | | | | Group 10 | | | |
|---|---|---|---|---|---|---|---|---|---|---|---|---|---|---|---|---|
| Alloy | Composition B | | | | Composition B | | | | Composition E | | | | Composition E | | | |
| Treatment (see key) | C1 | C2 | D1 | D2 | C1 | C2 | D1 | D2 | C1 | C2 | D1 | D2 | C1 | C2 | D1 | D2 |
| 10 days | PP | PP | PP | PP | PP | PP | PP | PP | PP | PP | PP | PP | PP | PP | PP | PP |
| 20 days | PP | PP | PP | PP | PP | PP | PP | PP | PP | PP | PP | PP | PP | PP | PP | PP |
| 30 days | PP | PP | PP | PP | PP | PP | PP | PP | PP | PP | PP | PP | PP | PP | PP | PP |
| 40 days | PP | PP | PP | PP | PP | PP | PP | PP | PP | PP | PP | PP | PP | PP | PP | PP |

Key
C = 1022° F. P = Pass
D = 1065° F. F = Fail
1 = 0 hr. hold/quench
2 = 1 hr. hold/quench

What is claimed is:

1. A method of improving the corrosion resistance of an extruded aluminum alloy article having an alloy composition containing zinc as an impurity and further containing solid solution alloying elements which remain substantially in solid solution over time such that the alloy composition is quench insensitive comprising the step of rapidly quenching the extruded aluminum alloy article after the article has been subjected to one of heating subsequent to extrusion of the article and formation of the article by extrusion thereof, the article being quenched being at an elevated temperature which puts the solid solution alloying elements in solution in a substantially uniform concentration distribution, said rapid quenching maintaining the substantially uniform concentration of the solid solution alloying elements to improve the corrosion resistance of the extruded aluminum alloy article.

2. The method of claim 1 wherein the aluminum alloy is an AA3000 series alloy.

3. The method of claim 2 wherein the AA3000 series alloy is AA3102.

4. The method of claim 1 wherein the aluminum alloy consists essentially of, in weight percent, about 0.1 to 0.5% Mn, about 0.05 to 0.12% Si, about 0.03% to 0.30% Ti, about 0.05 to 0.50% Fe, not more than 0.40% Cu with the balance aluminum and incidental impurities.

5. The method of claim 1 wherein the extruded aluminum alloy article is subjected to heating prior to rapid quenching thereof.

6. The method of claim 5 wherein the heating is brazing.

7. The method of claim 1 wherein the step of rapidly quenching further comprises rapidly quenching the extruded aluminum alloy article from the elevated temperature to about ambient temperature in not more than one second.

8. The method of claim 5 wherein the step of rapid quenching further comprises rapidly quenching the extruded aluminum alloy article from the elevated temperature to about ambient temperature in not more than one second.

9. The method of claim 6 wherein the step of rapidly quenching further comprises rapidly quenching the extruded aluminum alloy article from the elevated temperature to about ambient temperature in not more than one second.

10. The method of claim 1 wherein the aluminum alloy is selected from the group consisting of AA2000 series alloys, AA3000 series alloys, AA5000 series alloys, AA6000 series alloys, and AA8000 series alloys.

11. The method of claim 1 wherein the aluminum alloy article is an AA3000 series alloy and the elevated temperature is at least 427° C.

12. The method of claim 1 wherein the aluminum alloy article is an AA3000 series alloy and the elevated temperature is at least 398° C.

13. The method of claim 1 wherein the extruded aluminum alloy article after extrusion is heated and then rapidly quenched.

14. A method of improving the corrosion resistance of an extruded aluminum alloy article, wherein the extruded aluminum alloy article has an alloy composition containing solid solution alloying elements which remain substantially in solid solution over time such that the alloy composition is quench insensitive, the alloy consisting essentially of, in weight percent, about 0.1 to 0.5% Mn, about 0.05 to 0.12% Si, about 0.03 to 0.30% Ti, about 0.05 to 0.50% Fe, not more than 0.40% Cu with the balance aluminum and incidental impurities, the method comprising: forming the article by extrusion thereof at an elevated temperature high enough to put the solid solution alloying elements of the alloy in a substantially uniform concentration distribution, rapidly quenching the extruded aluminum alloy article to substantially ambient temperature prior to cooling of the extruded article from the elevated temperature to a temperature at which microsegregation of solid solution alloying elements occurs to thereby maintain the substantially uniform concentration distribution of the solid solution alloying elements and improve the corrosion resistance of the aluminum alloy article.

15. A method of improving the corrosion resistance of an extruded aluminum alloy article, wherein the extruded aluminum alloy article has an alloy composition containing solid solution alloying elements which remain substantially in solid solution over time such that the alloy composition is quench insensitive, the alloy consisting essentially of, in weight percent, about 0.1 to 0.5% Mn, about 0.05 to 0.12% Si, about 0.03 to 0.30% Ti, about 0.05 to 0.50% Fe, not more than 0.40% Cu with the balance aluminum and incidental impurities, the method comprising: forming the article by extrusion thereof, using the extruded article in a fabrication process that raises the temperature of at least a portion thereof to an elevated temperature high enough to put solid solution alloying elements of the alloy in a substantially uniform concentration distribution, and rapidly quenching the extruded aluminum alloy article from the elevated temperature to substantially ambient temperature in less than one second to thereby maintain the substantially uniform concentration distribution of the solid solution alloying elements and improve the corrosion resistance of the at least a portion of the aluminum alloy article.

* * * * *